US005650026A

United States Patent [19]

Ganyo et al.

[11] Patent Number: 5,650,026

[45] Date of Patent: Jul. 22, 1997

[54] HEAT TREATING APPARATUS AND METHOD

[75] Inventors: Richard A. Ganyo, Eagan; James S. Nelson, Mounds View; David E. Bannick, Roseville, all of Minn.

[73] Assignee: Illinois Tool Works Inc., Glenview, Ill.

[21] Appl. No.: 568,242

[22] Filed: Dec. 6, 1995

[51] Int. Cl.[6] ..... C21D 1/54

[52] U.S. Cl. ..... 148/511; 266/87

[58] Field of Search ..... 148/511, 549, 148/508, 469, 702; 266/80, 87, 99, 249, 259

[56] References Cited

U.S. PATENT DOCUMENTS 5,306,359 4/1994 Eppeland et al. ..... 148/511
5,336,344 8/1994 Wei ..... 148/549
5,340,418 8/1994 Wei ..... 148/549
5,485,985 1/1996 Eppeland et al. ..... 266/87
5,536,337 7/1996 Wei ..... 148/549

*Primary Examiner*—Scott Kastler
*Attorney, Agent, or Firm*—Thomas Buckman; John O'Brien; Donald Breh

[57] ABSTRACT

A plurality of treatment station includes a plurality of heat treatment portions and staging portions. The staging portions utilize non-contact temperature sensors to measure an intensity of infrared radiation emitted from a part to be heat treated. A plurality of wavelengths of infrared energy emitted from a part are read with the wavelengths used as inputs to an empirical equation to calculate an apparent actual temperature of the part. The staging portions and the heat treatment portions are shielded to prevent infrared energy from the heat treatment portion from interfering with the accuracy of the staging portions.

10 Claims, 7 Drawing Sheets

HEAT TREATING APPARATUS AND METHOD

I. BACKGROUND OF THE INVENTION

1. Field of the Invention

This invention pertains to heat treatment. More particularly, this invention pertains to heat treatment of metallic parts utilizing direct infrared radiation as the heat source.

2. Description of the Prior Art

The present invention describes an improved apparatus and method to the teachings of commonly assigned U.S. Pat. No. 5,306,359. That patent teaches an apparatus and method for heat treating metallic parts with direct infrared radiation as the heat source. As described in the '359 patent, the preferred embodiment utilizes the apparatus and method for heat treating aluminum or aluminum alloy parts such as automobile or truck wheels.

As disclosed in U.S. Pat. No. 5,306,359, the heat treatment of cast or forged aluminum parts requires heating the part to a desired temperature and then rapidly cooling the part. For example, an aluminum part may need to be heat treated to about 1,020° F. and then rapidly cooled or quenched by immersing the part in water or other quenching fluid. After quenching, the part is reheated to about 300–500° F. in an aging stage and held at the aging temperature for a period of time.

As disclosed in U.S. Pat. No. 5,306,359, historical heat treatment techniques for aluminum alloys were very time consuming and capital intensive. Also, as disclosed in that patent, the historical techniques for heat treating parts such as aluminum alloy wheels perform the heat treatment in a batch process. For example, a plurality of aluminum castings or forgings are placed on a pallet or other device in a common oven and heat treated or aged as a collective group. Accordingly, there may be variations among the various parts of the batch. As a result, certain parts in the batch may not be suitably heat treated and may be subject to rejection. Also, during the quenching stage, the entire batch is placed in a quenched liquid. Since the parts are commonly stacked one upon the other, the quenching fluid cannot adequately surround the entire surface of each part in the batch. Further, due to the fact that the parts are batch treated, there is no unique metallurgical history as to the specific heat treatment of each part.

In U.S. Pat. No. 5,306,359, each part is uniquely heat treated in a series of heat treatment stations. Each of the heat treatment stations includes infrared radiation lamps for directly heating the part with infrared radiation. A part is sequentially moved from station to station. As shown best in FIGS. 1 and 2 of the '359 patent, the part is heated while rotating the part within a station to assure uniform heating. Infrared radiation lamps do not completely surround the part. Instead, the lamps are positioned on an upper surface and two opposing sidewalls of the heat treatment station. To permit passage of a part from one station to another, the stations do not have end walls separating the stations. As a result, infrared radiation lamps are not positioned on any end walls and, therefore, there are no infrared lamps surrounding the part on all sides.

As disclosed in U.S. Pat. No. 5,306,359, it is important to determine the actual temperature of a part prior to the part being admitted to any subsequent heat treatment station. The temperature is used by a controller of the device in order to independently control the infrared radiation lamps within any given heat treatment station. Namely, by knowing the temperature of the part admitted to a heat treatment station, the controller can calculate the amount of intensity required by the lamps in the particular station such that the heat treating within that station and within any anticipated subsequent heat treatment station will elevate the part to a desired final temperature.

As indicated in U.S. Pat. No. 5,306,359, measurement of the actual temperature of an aluminum alloy part is difficult. The most precise way to measure such a temperature is to implant a thermocouple within the part. However, this is not practical in a process intended for the mass heat treatment of a large number of parts. Accordingly, U.S. Pat. No. 5,306,359 utilizes optical pyrometers or other non-contact, infrared sensors to measure the actual temperature of a part.

Aluminum is extremely non-emissive. The low emissivity of aluminum makes temperature measurement with optical pyrometers difficult. In U.S. Pat. No. 5,306,359, a method for calculating the actual temperature of the part is disclosed where an optical pyrometer is aimed at the part and a separate optical pyrometer is aimed within the heat treatment chamber to measure background radiation. Further, a thermocouple is placed within the refractory wall of the chamber. The combination of readings from the optical pyrometer measuring off of the part, the optical pyrometer measuring background radiation within the heat treatment station and the thermocouple measuring the temperature of the refractory are applied to an empirical equation to determine an apparent actual temperature of the part. In practice, the lamps used to heat the part remain emissive and may interfere with the actual measurement of the temperature of a particular part.

It is an object of the present invention to provide an apparatus and method for uniquely heating a plurality of metallic parts with an improved apparatus and method for both heating the parts and for measuring the actual temperature of a part at any given location within the apparatus.

II. SUMMARY OF THE INVENTION

According to a preferred embodiment of the present invention, a method and apparatus for continuously and individually metallurgically heat treating a plurality of individual metallic parts is disclosed. Each of the parts has a unique initial temperature. The parts are heated to a common desired final temperature in an apparatus having a plurality of treatment stations, each having a heat treatment portion with separately controllable infrared heating lamps and a staging portion having temperature measuring devices for measuring an apparent actual temperature of a part within each of the staging portions.

The treatment stations are arranged along a path of travel. The apparatus and method sequentially and simultaneously move each of the parts individually along the path of travel to each of the treatment stations. A part exiting any given one of the stations is admitted to an immediately following one of the stations.

Prior to admission of a part to a heat treatment portion, the apparent actual temperature of the part is determined. A part is held within the heat treatment portion with all of the parts held in heat treatment portions at any one time being held for a common residence time.

The intensity of the infrared lamps in each of the heat treatment portions is separately controlled. Each of the parts is uniquely heated at an intensity selected for the heat treatment in the particular heat treatment portion and any subsequent anticipated heat treatment in subsequent heat treatment portions selected for the part to be heated from the apparent actual temperature to the desired final temperature upon exiting a final station of the apparatus.

Upon completion of the residence time, all parts are separately and simultaneously moved to subsequent stations until a part has exited the final station in the apparatus. During the measuring of the temperature of the part, the staging portions are shielded from the heat treatment portions to avoid interference of infrared energy in the measurement process.

III. BRIEF DESCRIPTION OF THE DRAWINGS

IV. DESCRIPTION OF THE PREFERRED EMBODIMENT

Referring to the several drawing figures in which identical elements are numbered identically throughout, a description of a preferred embodiment of the present invention will now be provided. The present invention is shown and described as an improvement to an apparatus and method disclosed in commonly assigned U.S. Pat. No. 5,306,359, the teachings, specification, claims and drawings of which are incorporated herein by reference.

Figure 1:
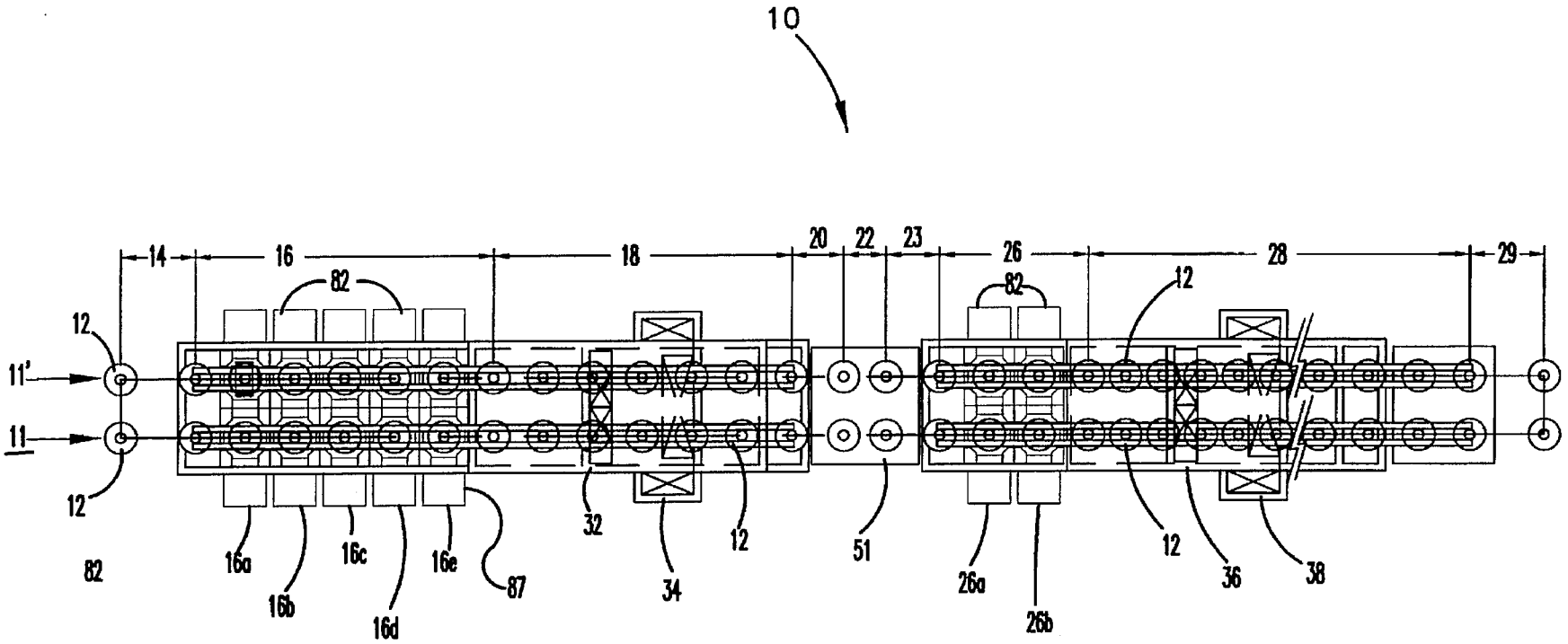
FIG. 1 is a top plan view of a heat treatment apparatus shown in schematic format and according to the present invention.
Figure 2:
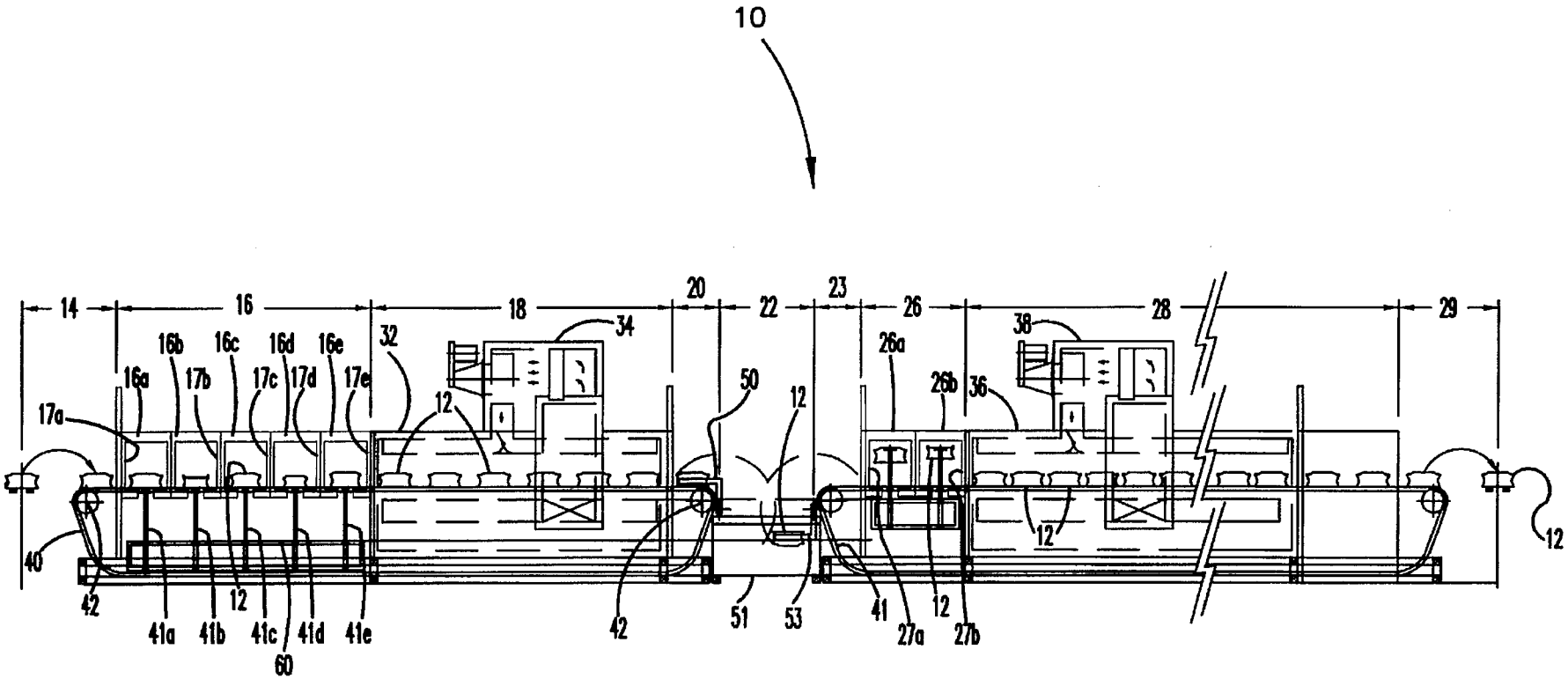
FIG. 2 is a side elevation schematic view of the apparatus in FIG. 1.

With initial reference to FIGS. 1 and 2, the apparatus 10 is shown as an assembly line for heat treating a plurality of metallic parts 12. In the preferred embodiment, the parts 12 are forged aluminum alloy wheels. Such wheels have a circumferential wall joined by one sidewall with an opposite side being open (as is conventional).

The assembly line of apparatus 10 may be conveniently divided into a plurality of functionally distinct zones. For example, the apparatus 10 begins at a load zone 14 followed by an IR heat treat zone 16. As will be described, in the heat treat zone 16, the parts 12 are heated to a desired heat treating temperature of about 1,020° F. in a preferred embodiment.

After the heat treat zone 16, the parts are admitted to a stabilization zone 18 for stabilizing the parts 12 at the desired final temperature. Subsequent to the stabilization zone 18, the parts 12 enter a first pick-and-place zone 20 wherein each of the parts 12 are individually picked and subsequently placed into a quench zone 22. After the quench zone 22, the parts 12 enter a second pick-and-place zone 23 where quenched parts are picked from the quench zone 22 and admitted to an IR aging zone 26.

In the IR aging zone 26, parts are heated to an aging temperature of about 400° F. Subsequent to the IR aging zone 26, the parts 12 are admitted to a holding zone 28 for holding the parts at the aging temperature for a desired length of time. Finally, subsequent to the IR aging zone 28, the parts are admitted to an unloading zone 29 so that the parts may be unloaded from the apparatus.

In the embodiment shown in FIG. 1, the apparatus 10 includes two parallel lines (11, 11') for heat treating two lines of parts 12 being passed along the apparatus 10. It will be appreciated that the apparatus 10 could have a single line 11 of parts 12 or more than two lines 11, 11' of parts 12.

With the apparatus 10 summarized above, a plurality of parts 12 are admitted at the loading zone 14 and removed from the unloading zone. 29. The parts 12 entering the loading zone 14 may come directly from a forge (or other forming process like casting or extruding) or from an inventory of parts awaiting heat treatment.

If the parts 12 come from inventory, they may be at ambient temperature within the factory (e.g., about 70° F.). Parts coming directly from the forge may be at elevated temperatures of about 700° F. Accordingly, a part will have a unique initial temperature ranging from about 70° F. to about 700° F.

In order to attain desirable heat treatment, it is required that the parts 12 each exit the IR heating zone 16 at a common desired final temperature of 1,000° F. Therefore, zone 16 must accept parts 12 of a wide variety of initial temperatures and uniquely heat each of the parts 12 to a common desired final temperature. A more detailed discussion of zone 16 will follow illustrating how zone 16 accomplishes this task.

In the stabilization zone 18, the parts have their final temperature of about 1,000° F. stabilized by surrounding the parts 12 with a plenum 32. Heated air is admitted to the plenum 32 from a hood 34. The heated air will be provided at a temperature of 1,000° F. such that each of the parts 12 is now completely surrounded by the heated air in order to stabilize the parts 12 at 1,000° F. The stabilized parts are then picked and placed by a first pick-and-place apparatus 50 (FIG. 2) in zone 20 into a quench tank 51 in zone 22.

The quench tank 51 contains quenching water or other liquid at a temperature of about 100° F.–200° F. to rapidly quench the parts 12. Since the parts 12 are admitted to the quench tank 51 individually, they are completely immersed and surrounded by the quenching fluid. The quenched parts are received from a second pick-and-place machine 53 (FIG. 2) at the pick-and-place zone 24 and admitted to the IR heat treatment aging zone 26.

In the aging zone 26, the temperature of the parts 12 is now elevated to about 400° F. The 400° F. parts 12 are admitted to the holding zone 28 which includes a plenum 36 having a plurality of hoods 38 (only one of which is shown) for admitting heated air into the plenum 36. Preferably, the heated air is admitted at a temperature of about 400° F. so that the parts 12 are soaked at 400° F. for a desired length of time. The length of the holding zone 28 is selected such that the parts moving through the holding zone 28 have a residence time within the holding zone 28 of about 45 minutes to ensure adequate soaking for a forged part 12 (a cast part 12 would require about 5–15 minutes). The aged parts are then removed at the unload zone 29.

The present invention utilizes a unique apparatus and method for infrared heat treating the parts 12 in both of zones 16 and 26. The apparatus includes treatment stations having heat treatment portions (e.g., 16*a*) and staging portions (e.g., 17*a*). Each of zones 16 and 26 includes a plurality of treatment portions. For example, segment 16 includes five heat treatment portions 16*a*, 16*b*, 16*c*, 16*d* and 16*e*. The aging segment 26 includes two such portions 26*a*, 26*b*.

Since the portions are identical, a description of portion 16*a* (with reference to FIGS. 3A, 3B, and 5) will suffice as a description of the remaining portions.

With attention now directed to FIGS. 1, 2, 3A, 3B, and 5, the apparatus 10 includes a carriage in the form of an indexing conveyor 40 (FIG. 2) to convey the parts 12 along a path of travel which is generally parallel to the longitudinal dimension of the apparatus 10. Carriage 40 transports parts through portions 14, 16, 18. A separate carriage 41 of similar construction transports parts through zones 26 and 28.

The conveyor 40 (FIGS. 3A, 3B, and 4) is a conveyor consisting of two endless chains 40*a*, 40*b* entrained around a plurality of pulleys 42 (FIG. 2) with a drive mechanism (not shown) for driving the conveyor 40. The conveyor 40 is not driven in a continuous motion but is instead indexed such that a part 12 is moved forward along the path of travel an incremental distance and then held at its new location for a prescribed period of time before being advanced to the next station. While conveyor 40 is shown as a chain, any conveyor may be used.

The heat treatment portions 16*a*–16*e* are positioned above the conveyor 40 and spaced therefrom by a distance greater than the height of a part 12 being heat treated. Accordingly, at each of the portions 16*a*–16*e*, a part 12 must be elevated into the heat treatment portion. The elevation into the heat treatment portion is provided by a plurality of lift-spindles 44*a*–44*e* associated with each of the heat treatment portions. When a part 12 is directly beneath a heat treatment portion (.i.e., such as portion 16*a*), an associated spindle (for example, spindle 44*a*) pushes the part 12 into the portion 16*a* and supports the part 12 within the portion 16*a*. Furthermore, the spindles 44*a*–44*e* may be rotated such that a part 12 is rotated within the heat treatment station during the heat treatment process to ensure uniform heat treatment.

As shown in the figures, the spindles 44*a*–44*e* are mounted on a support platform 60 positioned within the interior of the conveyor 40. The spindles 44*a*–44*e* are elevated by reason of the support platform 60 being connected to a lift mechanism best shown in FIGS. 3A, 3B where the lift mechanism is shown as endless chains 60*a*, 60*b* on opposite sides of the support 60 and are entrained around pulleys 62 so that the support mechanism 60 can be raised or lowered as illustrated.

Figure 3A:
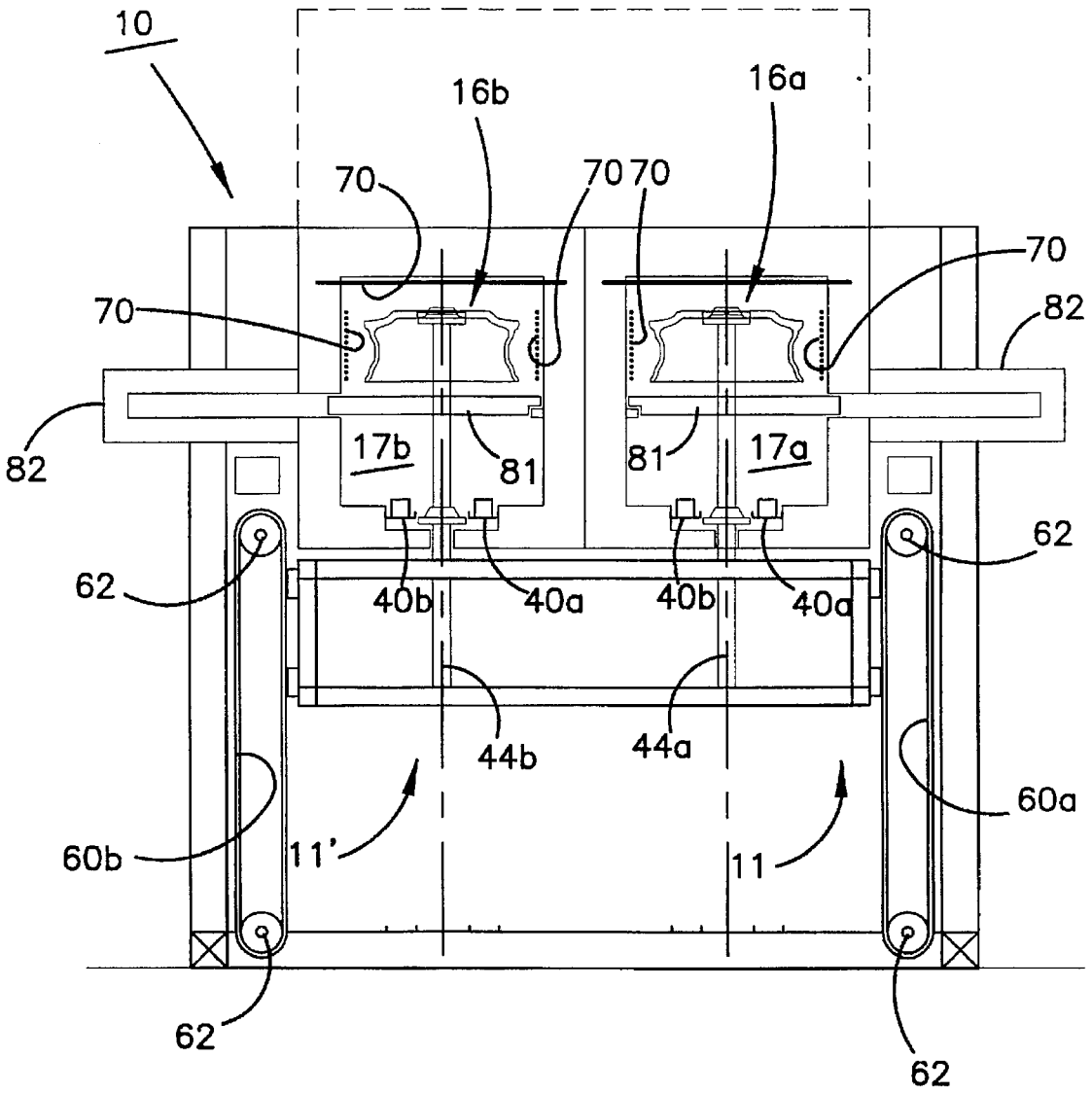
FIG. 3A is a cross-sectional view of the apparatus of FIG. 2 with parts shown in an up position in heat treatment portions.
Figure 3B:
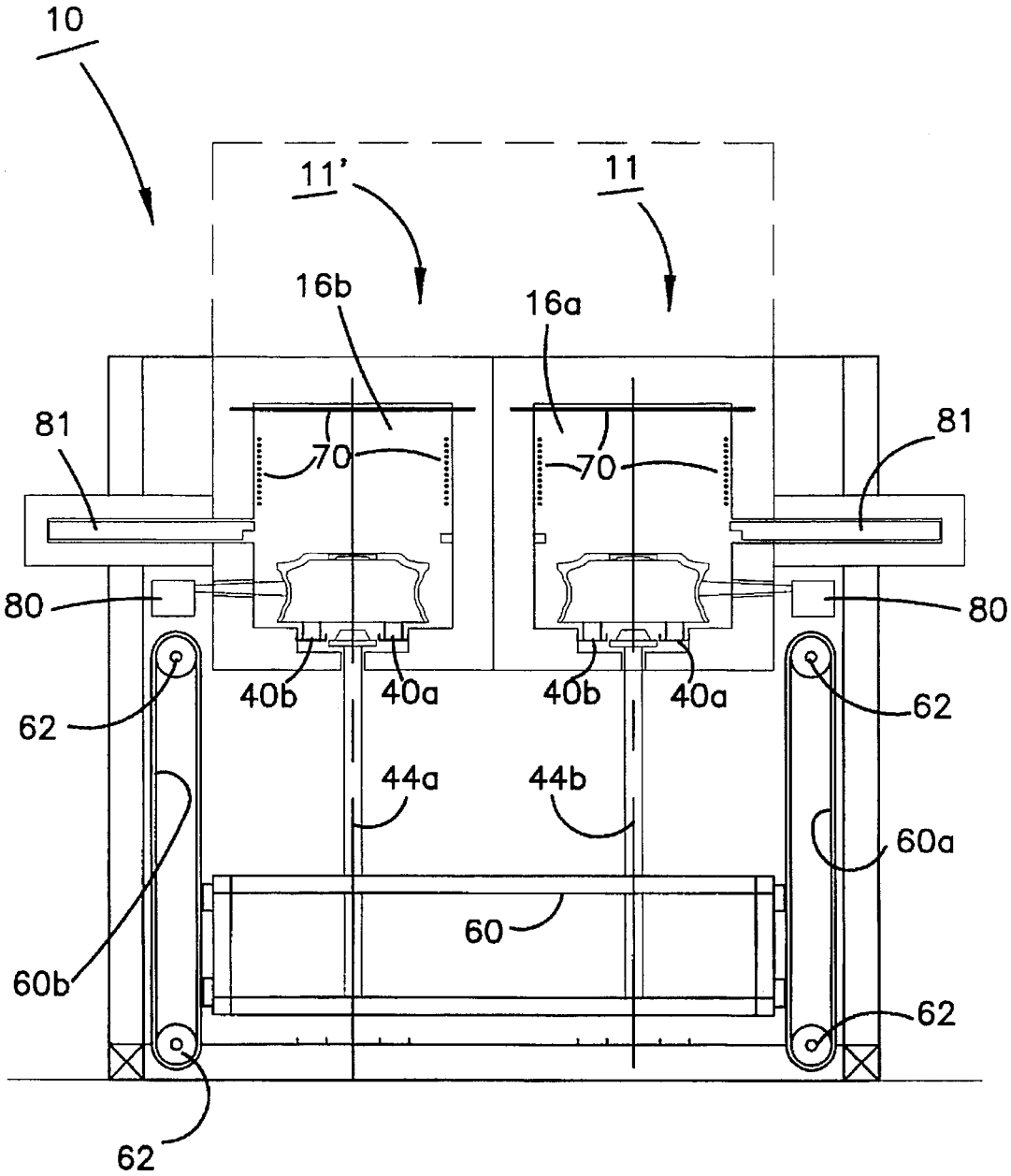
FIG. 3B is the view of FIG. 3A with parts shown in a down position in staging portions.
Figure 4:
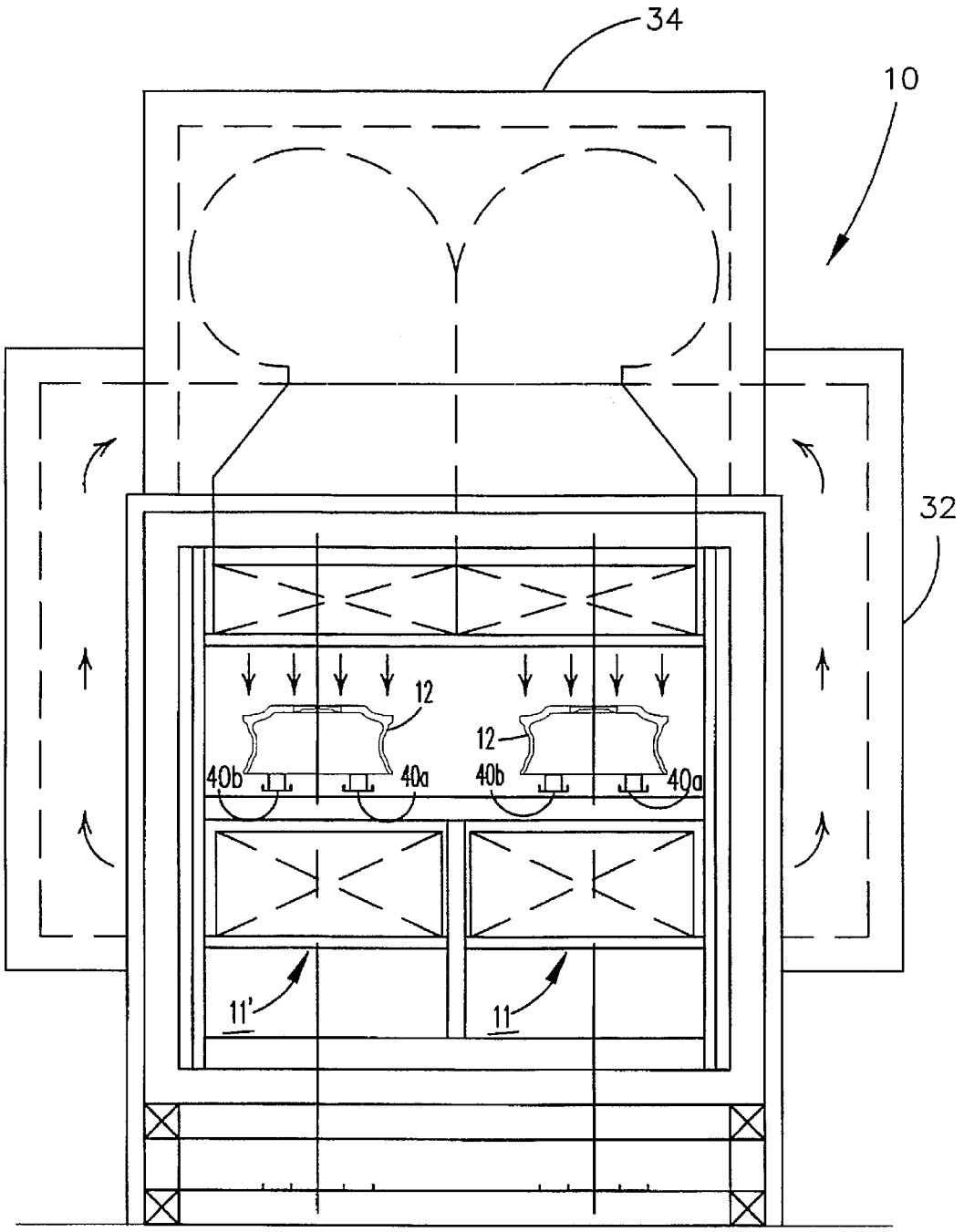
FIG. 4 is a cross-sectional view of a soaking station.

Beneath the heat treatment portions, temperature measurement (or staging) portions 17*a*–17*e*, 27*a*–27*b* are provided. The staging portions are not shown entirely in FIGS. 1 and 2 for ease of illustration but are shown in FIGS. 3A, 3B with the staging portion 17*a* shown positioned beneath heat treatment portion 16*a*. The staging portions 17*a*–17*e* are positioned such that when a part 12 is being conveyed by conveyor 40, the part 12 is automatically admitted into the staging portions 17*a*–17*e*. The parts are then lifted from the staging portions 17*a*–17*e* into their associated heat treatment portions 16*a*–16*e* by reason of the spindles 44*a*–44*e* being lifted as illustrated in FIG. 3A. Lowering of the spindles returns the part to the staging portions 17*a*–17*e* as illustrated in FIG. 3B.

Figure 5:
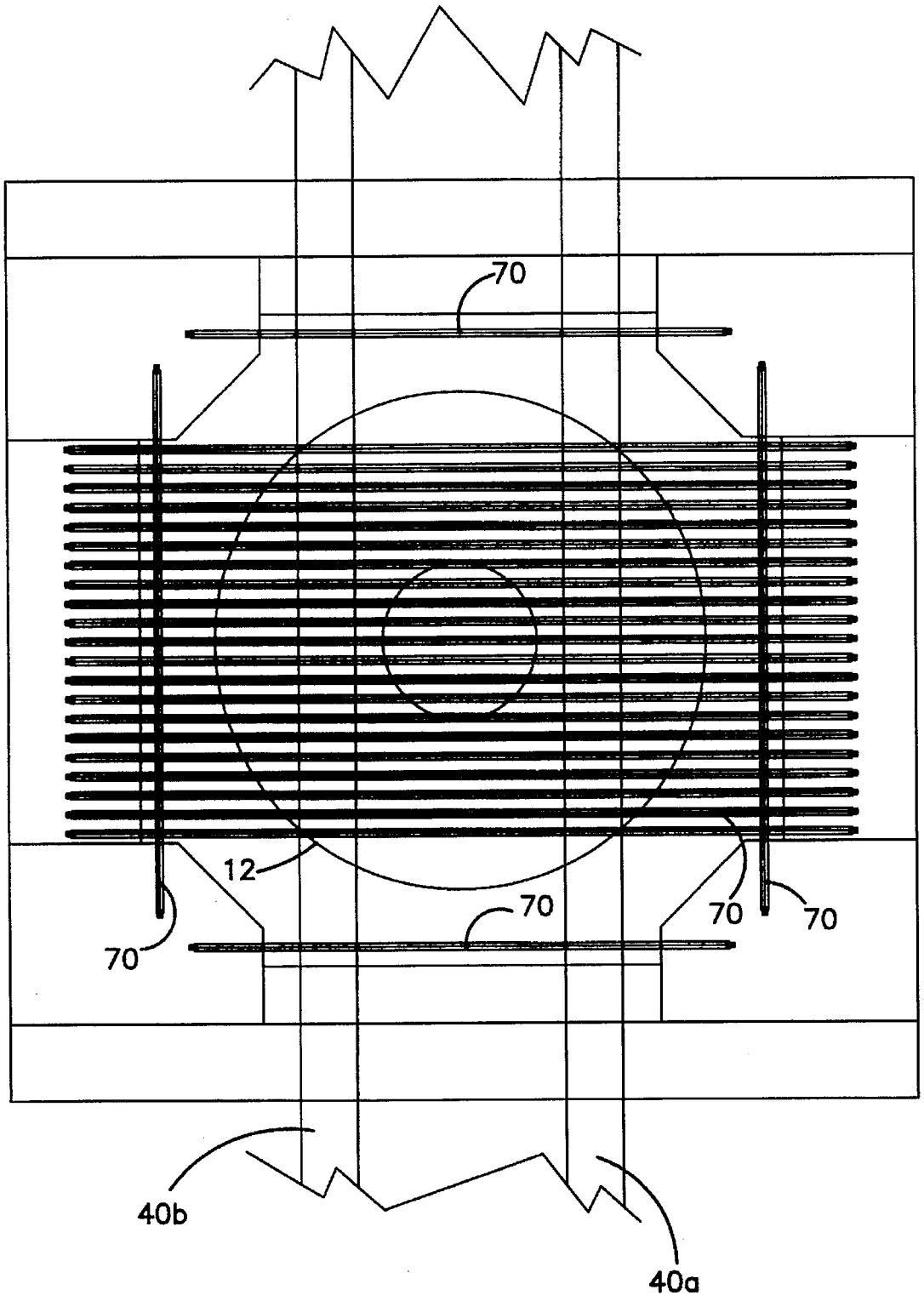
FIG. 5 is a top plan view of a heat treatment portion showing internal heating elements.

Within the heat treatment portions 16*a*–16*e*, a plurality of infrared lamps 70 are provided on all but the bottom wall of the heat treatment portions 16*a*–16*e* (see FIGS. 3A, 3B and 5). Accordingly, the infrared lamps 70 are provided on the top wall and four sidewalls thereby surrounding and opposing a part 12 to be heat treated from five different surfaces of the heat treatment portions 16*a*–16*e*.

The staging portions 17*a*–17*e* are each provided with a non-contact temperature sensor (for example, optical pyrometers 80 shown in FIG. 3B only), disposed and directed to measure radiated energy from a surface of a part 12 within the staging portions 17*a*–17*e*. Preferably, the part 12 is rotated by spindles 44*a*–44*e* while pyrometers 80 measure radiated energy. The optical pyrometers 80 are selected to have internal filters for measuring a minimum of three infrared wavelengths emitted from a part 12 within the staging portions 17*a*–17*e*. Preferably, for forged aluminum wheels, the three measured wavelengths are 1.25, 2.1 and 2.4 microns. A single optical pyrometer capable of measuring three wavelengths can be used or, alternatively, three pyrometers can be used, each measuring a unique wavelength.

A sliding door 81 (FIGS. 3A, 3B) is provided which slides into a pocket 82 to provide an unobstructed pathway between the staging portions 17*a*–17*e* and the heat treatment portions 16*a*–16*e*. With the door 81 in the open position (FIG. 3B), the spindles 44*a*–44*e* may elevate a part from the staging portions 17*a*–17*e* into the heat treatment portions 16*a*–16*e* or return a part 12 from the heat treatment portions 16*a*–16*e* into the staging portions 17*a*–17*e*.

While a part 12 is in the staging portions 17*a*–17*e* having the emissivity of the part 12 detected by the pyrometer 80, the door 81 is placed in a closed position. Also, while the part is subject to infrared heating in the temperature measuring position 16*a*–16*e*, the door 81 is placed in the closed position shown in FIG. 3B. The doors 81 may be provided with a slot or the like (not shown) to permit the doors 81 to close without being obstructed by the spindles 44*a*–44*e*.

It will be noted that the doors 81 are closed to separate and shield the staging portions 17*a*–17*e* from the infrared heat treatment portions 16*a*–16*e* during both the infrared heating of a part 12 within the heat treatment stations 16*a*–16*e* or during the infrared sensing of a part 12 within the staging portions 17*a*–17*e*. The doors 81 prevent infrared radiation from the lamps 70 in the heat treatment portions 16*a*–16*e* from penetrating into the staging portions 17*a*–17*e* and otherwise interfering with the accuracy of the measurement within the staging portions 17*a*–17*e*. Further, with the structure thus described, the heat treatment stations 16*a*–16*e* may be provided with infrared lamps 70 on both a top wall and on four side walls of the station to increase the amount of infrared radiation directed at a part over that shown in U.S. Pat. No. 5,306,359 (which only provided infrared heating lamps on the top wall and two sidewalls).

Also, unlike the teachings of U.S. Pat. No. 5,306,359, Applicants are not measuring background emissivity nor is Applicants providing a thermocouple to measure wall temperature. Instead, Applicants are measuring three different wavelengths off of a part 12 and using the three measured wavelengths to provide an indication of the actual temperature of the part 12 within the temperature measuring portion. Applicants have determined that the emissivity on an aluminum part may vary from one area on the surface of the part 12 to the other due to a wide variety of factors including oxides on the surface, oils burnt onto the surface or other factors which may affect thermal radiation.

By using multiple wavelength sensing pyrometers to measure at three different wavelengths, Applicants have provided a means for accurately measuring the actual temperature of a part 12. Namely, during tests on various parts 12, Applicants place a thermocouple on a test part to measure an actual temperature of the test part. Using the same optical pyrometers and wavelengths as to be used in the apparatus 10, Applicants measure the intensities emitted from the test part at the three wavelengths at various known temperatures (as measured by the thermocouple). Applicants then correlate this information of the measured intensities at the three wavelengths as independent variables and the actual temperature as a dependent variable to provide an empirical equation. Using the empirical equation in control of the apparatus 10, the intensity of the three wavelengths emitted from a part 12 are measured and the measured wavelengths are placed as independent variables in the empirical equation to provide and generate an apparent actual temperature of the part 12. By using three wavelengths, Applicants have found that a correlation equation using three or more wavelengths provides a very high accuracy between the actual temperature of a part 12 (as measured by a thermocouple in a test application) and the apparent actual temperature of the part 12 (as determined by the empirically derived equation).

Using the apparatus and method thus described, a part is completely preheated in zone 16 of apparatus 10 as shown in FIG. 1. For example, a part 12 from inventory at ambient temperature of 70° is loaded at zone 14. In portion 16*a*, the part has its initial temperature read in portion 17*a*. It is desired that the part will be raised to a temperature of about 290° F. in portion 16*a* in order to prepare it for subsequent heat treating in the subsequent heat treatment portions 16*b*–16*e*.

The controller 200 (FIG. 6 as will be described) of the apparatus 10 controls the intensity of the infrared lamps 70 within portion 16*a* for a known residence time to increase the temperature of the part to about 290° F. After the residence time, the part 12 is lowered from portion 16*a*back into the first staging portion 17*a*. The apparent actual temperature is measured which may be greater than or less than the desired temperature of 290° F. The part 12 is then advanced to beneath portion 16*b* and elevated into the heat treatment portion 16*b*. Using the apparent actual measured temperature after the part 12 has left portion 16*a*, the controller then controls the intensity of the infrared lamps 70 in portion 16*b* to hit a target temperature of about 510° F. After this heat treating, the part 12 is lowered from portion 16*b* and advanced to beneath portion 16*c* by movement of the conveyor At the staging portion 17*c*, the actual temperature of the part (i.e., its exit temperature from portion 16*b*) is measured and the part 12 is elevated into the heat treatment portion 16*c*. The controller utilizes the apparent actual measured temperature of the part and adjusts the intensity of the infrared lamps in heat treatment portion 16*c* to an amount calculated such that the temperature of the part leaving portion 16*c* is at 730° F. after heat treatment during the residence time. Following such heat treatment, the part is lowered and advanced to beneath portion 16*d*. In either of the staging portions 17*c*or 17*d* beneath portion 16*c* or beneath portion 16*d* (but subsequent to the part being admitted into heat treatment portion 16*d*), the actual temperature of the part 12 is measured and the part is then admitted into heat treatment portion 16*d* by elevation of the spindles 44*d*.

Within portion 16*d*, the intensity of the infrared lamps 70 is controlled by the controller 200 such that the part 12 is heat treated from the apparent actual measured temperature to a desired exit temperature of 950° F. Following the residence time, the part 12 is then lowered and advanced to beneath portion 16*e*. Again, in either of the staging portions 17*d* or 17*e* beneath portion 16*d* or 16*e*, the apparent actual temperature of the part 12 is measured before it is admitted into heat treatment portion 16*e*.

Within portion 16*e*, the part 12 is then finally heat treated at an intensity controlled to elevate the temperature of the part from the apparent actual measured temperature to the desired final temperature of about 1,000° F. The part 12 is then lowered and the final apparent actual temperature as measured to insure the target final temperature has been attained. A part can be rejected if it does not attain the final.

As the conveyor 40 is advanced, the part 12 is admitted to the stabilization zone 18 where the part 12 continues to pass through the stabilization zone 18 as the conveyor 40 continues to be advanced along the line of travel. Within the stabilization zone 18, the heated air maintains and stabilizes the temperature of the part 12 at 1,000° F. The stabilization zone has a length equal to approximately six lengths of heat treatment portions. Accordingly, if the residence times within the individual heat treatment portions is 2 minutes, the residence time within the stabilization zone 18 is 12 minutes. Following such stabilization, the parts are quenched in quench tank 51. These residence times may vary for any desired metallurgical treatment for any specific alloy or forming process.

After quenching, the parts are admitted to the IR heating zone 26 which has a conveyor 41 similar to conveyor 40 which extends the entire length of the IR aging zone 26 and the holding zone 28. Since the IR aging zone 26 only heats parts from a relatively stable temperature of 100°–200°, only two heat treatment portions 26*a*, 26*b* temperature measurement portions 27*a*, 27*b* are provided within the zone 26 which operate in a manner identical to that described with respect to zone 16.

With the example thus given, it was assumed that a part 12 was taken from inventory at an ambient temperature of 70°. If the part 12 is taken from a forging machine, it may at an initial temperature of about 700° F. Since its actual initial temperature is measured prior to being admitted into each of portions 16*a*, 16*b*, 16*c*, 16*d* and 16*e*, the controller may control the intensity of the infrared lamps in portions 16*a*, 16*b* such that they are not energized and the part 12 remains at its 700° temperature until admitted to portion 16*c* at which point the lamps 70 may be only slightly energized to elevate the temperature of the part to 730° F.

Figure 6:
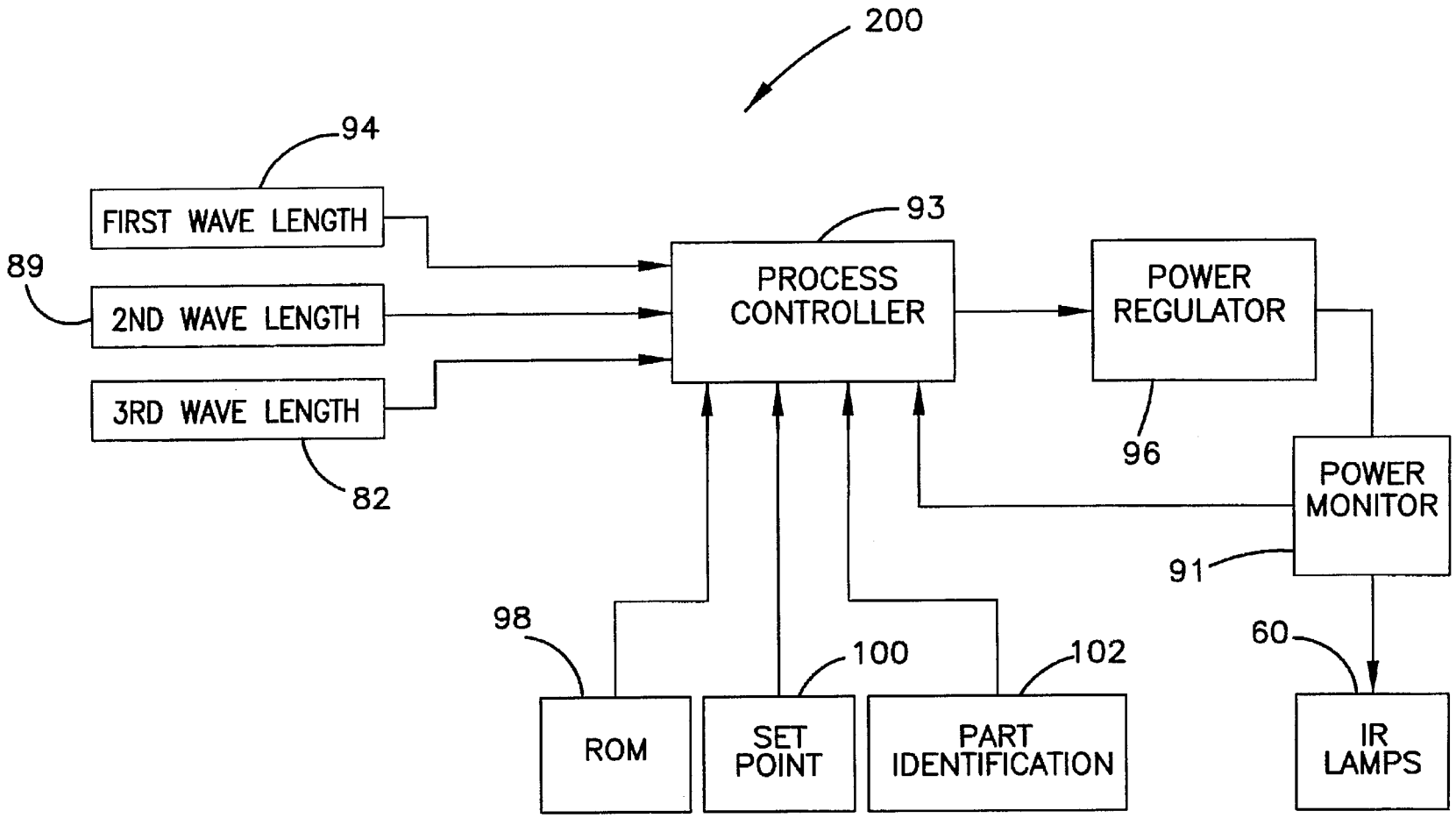
FIG. 6 is a schematic representation of a controller for controlling the operation of the apparatus.

FIG. 6 illustrates a control for use in controlling the heat treatment portions of the apparatus. The control system 200 controls the intensity of the lamps in each of the heat treatment portions. As shown, the control system 200 includes a process controller 93 which includes software for calculating the apparent actual temperature of a part. The input no the process controller 93 includes the measured intensity of the three desired wavelengths from three optical pyrometers (numbered 82, 89, 94) (or three wavelengths from one optical pyrometer which has filters to accept the three wavelengths only). The controller 93 uses memory 98 which includes the empirical data for converting the information of the intensities of the three measured wavelengths to the apparent actual temperature of the part.

The controller 93 accepts as inputs the apparent actual temperature as well as a set point 100 which is a desired target temperature for a part exiting the heat treatment portion. Further, the controller 93 accepts as input part identifying factors 102 such as the mass of the part. Utilizing the inputs, the controller 93 calculates the amount of power required to energize the lamps within the heat treatment portion for a set period of time calculated to heat the part from the apparent actual temperature to the desired target temperature 100. The process controller 93 controls a power regulator 96 which controls the IR lamps 60. A power monitor 91 monitors the power being delivered to the lamps 60 and advises the process controller 93 of the actual amount of power being used. The power monitor 91 will provide a feedback if IR lamps 60 are burned out or otherwise not operating at the desired power level.

With the teachings of the present invention, one skilled in the art will recognize the importance of the plurality of heat treating stations for advancing the part and for heat treating the part in a relatively small period of time. For example, a part may be admitted at load station 14 and unloaded at unload zone 30 after a total of 68 minutes compared to much longer heat treating required by prior art devices. Also, the utilization of the sliding doors to isolate the heat treating stations from the temperature measuring stations permits more accurate measuring of the actual temperature of the part at any given position along the apparatus 10. Also, the use of three wavelengths being measured off of the part provides greater accuracy in determining the true accurate temperature of the part.

It has been shown how the objects of the invention have been attained in a preferred manner. Modifications and equivalents of the disclosed concepts such as those that readily occur to one skilled in the art are intended to be included within the scope of the invention.

What is claimed is:

1. A method for continuously and individually metallurgically heat treating a plurality of individual metallic parts each having an unique initial temperature with said method heating each of said parts to a common desired final temperature in an apparatus having a plurality of treatment stations each having (a) heat treatment portions including separately controllable infrared heating lamps and (b) staging portions, said plurality of treatment stations arranged along a path of travel, said method comprising:

sequentially and simultaneously moving each of said parts individually along said path of travel to each of said plurality of treatment stations with a part exiting any given one of said plurality admitted to an immediately following one of said plurality and with a different part in an immediately preceding one of said plurality admitted to said any one given of said plurality;

measuring an apparent actual temperature of a part in one of said staging portions immediately prior to admittance of said part to a heat treatment portion at each treatment stations;

holding each of said parts in respective ones of said plurality of heat treatment portions for a common residence time;

separately controlling an intensity of said lamps in each of said respective ones of heat treatment portions for each of said parts in each of said heat treatment portions to be uniquely heated at an intensity selected for said heat treatment in said respective ones of said heat treatment portions and any anticipated subsequent heat treating in any subsequent heat treatment portions selected for said part to be heat treated from said apparent actual temperature to said final temperature upon exiting a final one of said heat treatment stations;

upon completion of said residence time, repeating said moving, said holding and said controlling until a part has exited said final one of said treatment stations;

during said measuring, shielding said staging portions from said heat treatment portions to abate interference of infrared energy from said lamps interfering with temperature measurement in said staging portions.

2. A method according to claim 1 wherein said measuring includes sensing an emitted infrared energy from a part within each of said temperature measuring stations at a plurality of wavelengths and calculating said apparent actual temperature from measured intensities at each of said wavelengths.

3. A method according to claim 2 wherein said measuring includes electronically transmitting said measured intensities to a process controller including software for calculating said apparent actual temperature including empirical data for converting said measured intensities to said apparent actual temperature and calculating said apparent actual temperature by said controller with said empirically derived equation using said measured intensities at each of said wavelengths as variables for said equation.

4. A method according to claim 1 wherein, at each of said treatment stations, a part is mowed away from said path of travel and staging portion into said heat treatment portion.

5. A method according to claim 4 wherein said shielding includes enclosing said heat treatment portions after a part is admitted into said portions.

6. A method according to claim 1 comprising soaking said plurality of parts by moving said parts from said final one of said plurality of treatment stations and through a plenum of heated air having a temperature of said desired final temperature for a time selected to metallurgically soak said parts at said desired final temperature.

7. A method according to claim 6 comprising quenching said parts by individually immersing said parts in a quenching liquid subsequent to said soaking.

8. A method according to claim 7 comprising metallurgically aging said parts by heating said parts to an aging temperature and holding said parts at said aging temperature.

9. A method according to claim 4 wherein a part is moved upwardly from a staging portion into said heat treatment portion and moved downwardly from said heat treatment portion to said staging portion before being advanced to any subsequent heat treatment station.

10. A method according to claim 9 wherein said measuring is performed at each of said staging portions.

* * * * *